US006975313B2

(12) United States Patent
Kurumisawa

(10) Patent No.: US 6,975,313 B2
(45) Date of Patent: Dec. 13, 2005

(54) POWER SUPPLY CIRCUIT FOR DISPLAY UNIT, METHOD FOR CONTROLLING SAME, DISPLAY UNIT, AND ELECTRONIC APPARATUS

(75) Inventor: Takashi Kurumisawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 413 days.

(21) Appl. No.: 10/314,259

(22) Filed: Dec. 9, 2002

(65) Prior Publication Data

US 2003/0112231 A1 Jun. 19, 2003

(30) Foreign Application Priority Data

Dec. 12, 2001 (JP) ..... 2001-378418
Oct. 3, 2002 (JP) ..... 2002-291154

(51) Int. Cl.[7] ..... G09G 5/00
(52) U.S. Cl. ..... 345/212; 345/204; 345/210; 345/211; 345/214
(58) Field of Search ..... 345/87–90, 93, 345/95, 98–101, 204–207, 210–214, 694–699

(56) References Cited

U.S. PATENT DOCUMENTS

| | | | | |
|---|---|---|---|---|
| 6,262,704 | B1 * | 7/2001 | Kurumisawa et al. | 345/98 |
| 6,526,516 | B1 * | 2/2003 | Ishikawa et al. | 713/340 |
| 2002/0018059 | A1 * | 2/2002 | Yanagi et al. | 345/204 |
| 2002/0036624 | A1 * | 3/2002 | Ohta et al. | 345/204 |

FOREIGN PATENT DOCUMENTS

| | | |
|---|---|---|
| JP | A 64-78527 | 3/1989 |
| JP | A 2-87189 | 3/1990 |
| JP | A 6-348227 | 12/1994 |
| JP | A 7-336228 | 12/1995 |
| JP | A 8-211853 | 8/1996 |
| JP | A 10-10497 | 1/1998 |
| JP | A 10-11026 | 1/1998 |
| JP | A 10-269787 | 10/1998 |
| JP | A 10-312682 | 11/1998 |
| JP | A 11-288255 | 10/1999 |
| JP | A 2000-111867 | 4/2000 |
| JP | A 2000-250475 | 9/2000 |
| JP | A 2000-276111 | 10/2000 |
| JP | A 2000-305513 | 11/2000 |
| JP | A 2000-305524 | 11/2000 |
| JP | A 2000-330085 | 11/2000 |
| JP | A 2002-158096 | 5/2002 |
| JP | A 2002-189437 | 7/2002 |

* cited by examiner

*Primary Examiner*—Vijay Shankar
(74) *Attorney, Agent, or Firm*—Oliff & Berridge, PLC

(57) ABSTRACT

The invention prevents or substantially prevents the brightness from changing according to the number of pixels that are turned on in a display. A power supply circuit calculates the total number of pixels that are turned on using ON/OFF data RD that stipulates the ON/OFF state of the pixels 1400 and controls the output impedance of a power supply voltage that is transmitted to a display panel, so that the output impedance becomes lower as the calculated total number of the pixels increases.

8 Claims, 13 Drawing Sheets

| ADDED RESULT SMd | CK4 | CK3 | CK2 | CK1 |
|---|---|---|---|---|
| 0 | X | X | X | X |
| 1～ 1280 | X | X | X | O |
| 1281～ 2560 | X | X | O | X |
| 2561～ 3840 | X | X | O | O |
| 3841～ 5120 | X | O | X | X |
| 5121～ 6400 | X | O | X | O |
| 6401～ 7680 | X | O | O | X |
| 7681～ 8960 | X | O | O | O |
| 8961～10240 | O | X | X | X |
| 10241～11520 | O | X | X | O |
| 11521～12800 | O | X | O | X |
| 12801～14080 | O | X | O | O |
| 14081～15360 | O | O | X | X |
| 15361～16640 | O | O | X | O |
| 16641～17920 | O | O | O | X |
| 17921～19200 | O | O | O | O |

O : CK OUTPUT ASSERTED
X : CK OUTPUT DE-ASSERTED

FIG.9

POWER SUPPLY CIRCUIT FOR DISPLAY UNIT, METHOD FOR CONTROLLING SAME, DISPLAY UNIT, AND ELECTRONIC APPARATUS

BACKGROUND OF THE INVENTION

1. Field of Invention

The present invention relates to a power supply circuit for a display unit that transmits a power supply voltage to pixels, a method for controlling the power supply circuit, a display unit using the power supply circuit, and an electronic apparatus.

2. Description of Related Art

The related art includes various types of display units using electrooptical elements as pixels. In such a case, organic EL (Electro Luminescent) elements, liquid crystal elements, and so forth are used as the electrooptical elements. For example, data (a bit) to stipulate the ON/OFF state of the pixels is transmitted to each pixel. Further, it is determined whether or not a power supply voltage should be applied to the electrooptical elements that are used as the pixels according to the data. Subsequently, the pixels are turned on or turned off to display a predetermined image.

Japanese Unexamined Patent Application Publication No. 11-288255 discloses such a related art device.

SUMMARY OF THE INVENTION

However, when a screen image where the pixels are turned on over a relatively large area is displayed, the load on the power supply voltage is increased. Therefore, the power supply voltage is lowered and the brightness of pixels that are turned on becomes lower than what it should be (in a case where the pixels are lit when they are turned on). In other words, the pixels that are turned on are not bright enough.

Accordingly, the present invention provides a power supply circuit for a display unit, a method for controlling the power supply circuit, a display unit using the power supply circuit, and an electronic apparatus. The power supply circuit prevents or substantially prevents the brightness of pixels that are turned on from changing according to whether the area of a display produced by pixels that are turned on is large or small.

In order to address or achieve the above, the power supply circuit according to the present invention is a power supply circuit that transmits a power supply voltage to a display panel having pixels that are turned on when the power supply voltage is energized and that are turned off when the power supply voltage is non-energized. The power supply circuit includes a calculation circuit to calculate the total number of pixels that are turned on in the display panel, and a voltage generation circuit to make the output impedance of the power supply voltage variable and to transmit the power supply voltage to the display panel. Further, the power supply circuit includes a control circuit to control the output impedance of the voltage generation circuit so that the output impedance becomes lower as the total number of pixels calculated by the calculation circuit increases.

According to such a configuration, the total number of pixels that are turned on is calculated, and the output impedance of the voltage generation circuit to output the power supply voltage is controlled so that the output impedance becomes lower as the calculated total number increases. As a result, it becomes possible to reduce the fluctuation in the power supply voltage that occurs according to the total number of pixels that are turned on.

BRIEF DESCRIPTION OF THE DRAWINGS

FIG. 9 is a table illustrating the relationship between an added result and the details of clock signals that are to be output, the relationship being obtained by a clock-control circuit of the power supply circuit;

DETAILED DESCRIPTION OF PREFERRED EMBODIMENTS

Figure 1:
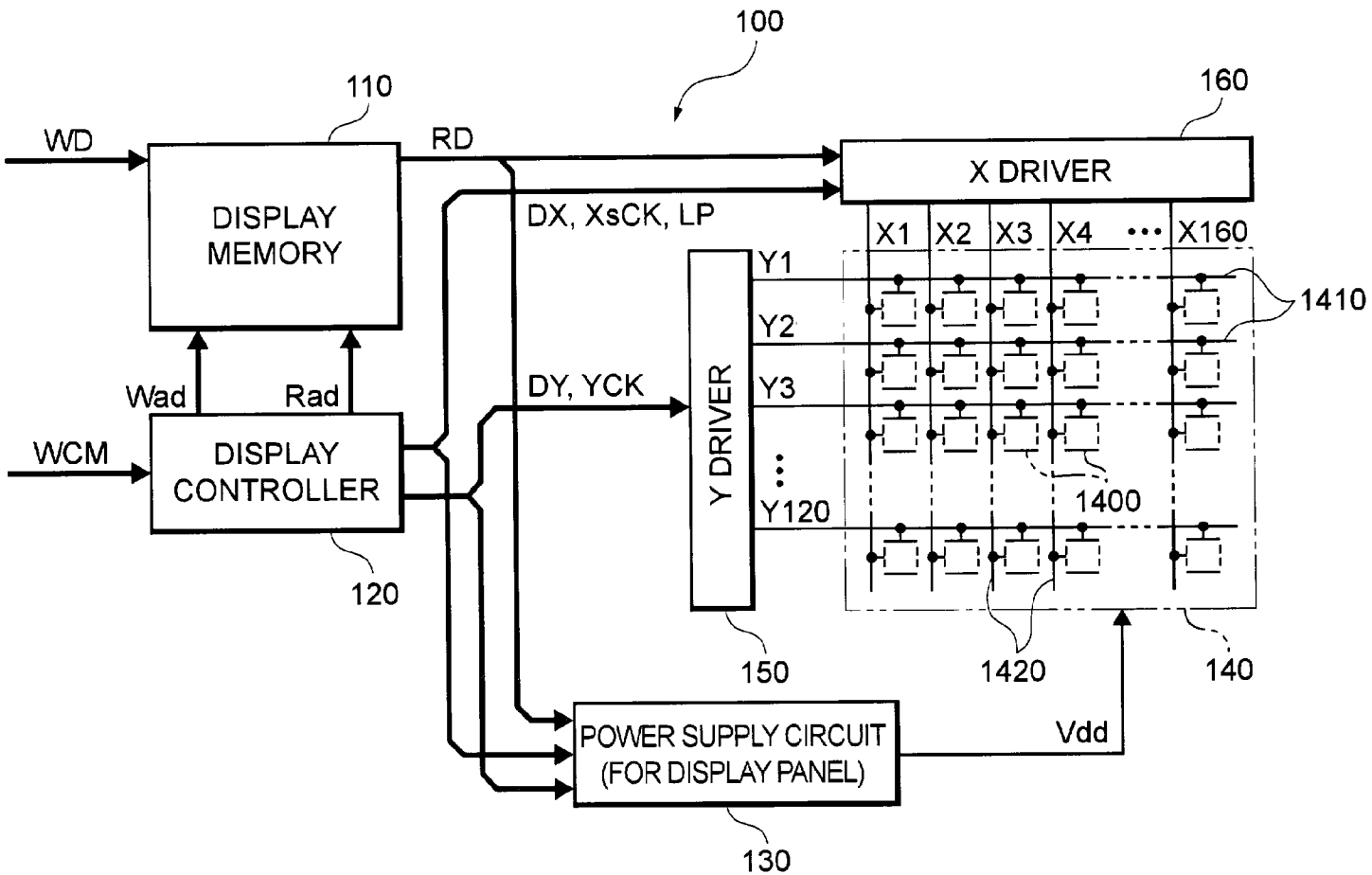
FIG. 1 is a schematic illustrating the configuration of a display unit according to embodiments of the present invention.

The embodiments of the present invention are described with reference to the drawings. FIG. 1 is a schematic illustrating the configuration of a display unit that uses a power supply circuit according to the embodiments of the present invention. As shown in FIG. 1, a display unit 100 includes a display memory 110, a display controller 120, a power supply circuit 130, a display panel 140, a Y-driver 150, and an X-driver 160.

Of these elements, the display memory 110 is a memory that is only used to display an image. The display memory 110 has a storage capacity that is at least large enough or larger than that required for the resolution of the display panel 140 and has memory addresses corresponding to each pixel of the display panel 140. Each of the addresses stores ON/OFF data (a bit) to determine whether the corresponding pixel is in an ON state (a lit state) or an OFF state (an unlit state).

The display controller 120 receives a command WCM from a higher-order control circuit that is not shown in FIG.

1. The command WCM includes information indicating that ON/OFF data WD to determine the content of a display is supplied and information about the write address of the ON/OFF data WD. Upon receiving the command WCM, the display controller 120 translates the command WCM and generates a write address Wad of the ON/OFF data WD. Further, the display controller 120 increments a read address Rad to read ON/OFF data from the display memory 110 in order according to vertical scanning and horizontal scanning, and generates a clock signal or the like in synchronization with the incrementing.

Therefore, during writing of the display memory 110, the ON/OFF data WD, which is supplied from the higher-order control circuit, is written in the write address Wad. During reading of the display memory 110, stored ON/OFF data RD is read in order according to vertical scanning and horizontal scanning of the display panel 140.

The details of the clock signal or the like generated by the display controller 120 are described below.

According to the embodiments, the display panel 140 is an organic electroluminescent (EL) device where pixels 1400 are aligned in 120 rows by 160 columns. More specifically, in the display panel 140, the pixels 1400 are provided at corresponding intersections of 120 scanning lines 1410 and 160 data lines 1420. The scanning lines and the data lines are provided to intersect each other.

The power supply circuit 130, which is a significant feature of the present invention, calculates the total number of pixels that are stipulated to be lit by the ON/OFF data RD, which is read from the display memory 110. Then, the power supply circuit 130 generates a power supply voltage Vdd in the display panel 140 according to the calculated result. The details of the power supply circuit 130 are described below.

The Y driver 150 sequentially supplies the scanning signals Y1, Y2, Y3, and Y120 to the 1st to 120th rows, respectively, of the scanning lines 1410. The X driver 160 sequentially latches the ON/OFF data RD, which is read from the display memory 110. Then, the X driver 160 supplies the ON/OFF data RD as data signals X1, X2, X3, . . . , and X160 to the 1st to 160th columns, respectively, of data lines 1420 at a time.

<Pixel Configuration>

Figure 2:
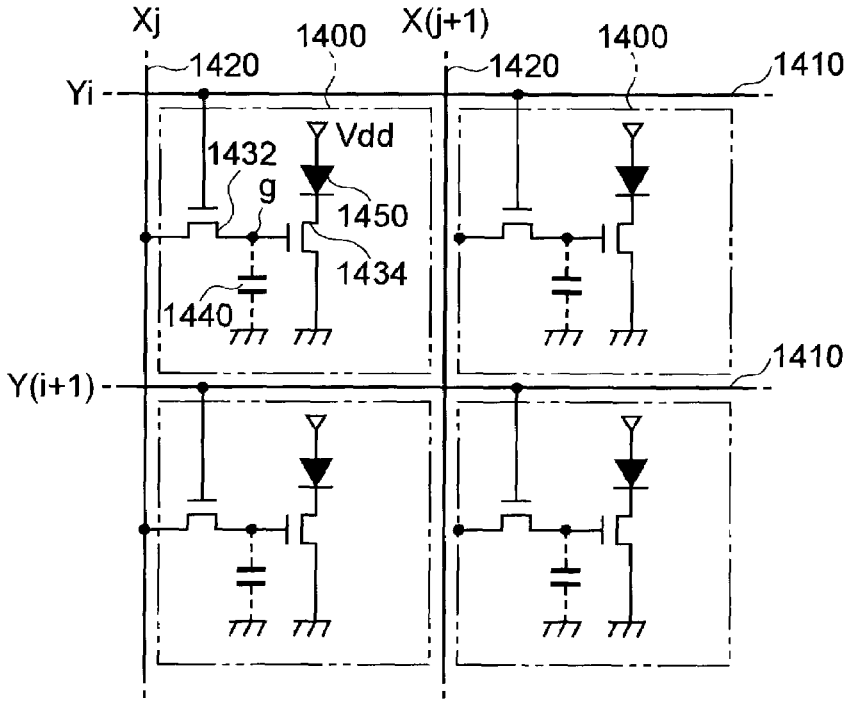
FIG. 2 is a circuit diagram illustrating a configuration of pixels in a display panel of the display unit.

Details of the above-described pixels 1400 are now described. FIG. 2 is a circuit diagram illustrating a configuration of four pixels at positions corresponding to the intersections of the adjacent row i and row i+1 of the scanning lines 1410 and the adjacent row j and row j+1 of the data lines 1420. Here, reference character i illustrates one typical scanning line 1410. Similarly, reference character j illustrates one typical data line 1420.

As shown in FIG. 2, each of the pixels 1400 includes thin-film transistors (hereinafter "TFTs") 1432 and 1434, and an EL element 1450.

As an example, the pixel 1400, which is provided at a position corresponding to the intersection of the scanning line 1410 of row i and the data line 1420 of column j, are described below. The TFT 1432 of the pixel 1400 is provided between the data line 1420 of column j and a gate g of the TFT 1434. The gate of the TFT 1432 is connected to the scanning line 1410 of row i. Therefore, the TFT 1432 functions as a switch that is turned on when a scanning signal Yi is at the H level. That is to say, the TFT 1432 functions as a switch to connect the data line 1420 to the gate g of the TFT 1434.

There is a parasitic capacitance 1440 at the gate g of the TFT 1434 (the drain of the TFT 1432). According to the embodiment, the parasitic capacitance of the TFT 1434 is used as the capacitance 1440. However, a capacitor may be provided between the gate g of the TFT 1434 and a feeding line at a predetermined potential (a grounding line, for example) to be used as the capacitance 1440.

The EL element 1450 is provided between the feeding line of the power supply voltage Vdd and the drain of the TFT 1434 in the forward direction. More specifically, the positive electrode of the EL element 1450 is connected to the feeding line of the power supply voltage Vdd, and the negative electrode of the EL element 1450 is connected to the drain of the TFT 1434. The source of the TFT 1434 is grounded to a reference voltage Gnd.

Here, the EL element 1450 has a light-emitting (EL) layer sandwiched between a positive electrode serving as a common electrode and a negative electrode serving as a pixel electrode. The details of the EL element 1450 are not described since they are unimportant or significantly unimportant to the present invention.

When the scanning signal Yi is at the H level in the pixel 1400, the TFT 1432 is turned on. Therefore, the gate g of the TFT 1434 is at the logic level of a data signal Xj that is applied to the data line 1420 of column j. Further, an electrical charge corresponding to the voltage is accumulated in the capacitance 1440.

When the scanning signal Yi is at the H level and the data signal Xj is at the H level, the TFT 1434 is turned on. Subsequently, the power supply voltage Vdd is applied and the EL element 1450 enters the ON state and emits light at a brightness level corresponding to the voltage. However, when the data signal Xj is at the L level when the scanning signal Yi is at the H level, the TFT 1434 is turned off and no voltage is applied. Subsequently, the EL element enters the OFF state so that the light is turned off (the unlit state).

When the scanning signal Yi is at the L level, the TFT 1432 is turned off. However, the capacitance 1440 maintains the gate g of the TFT 1434 at the logic level of the data signal Xj, that is, at the level that existed immediately before the TFT 1432 was turned off. Therefore, even though the scanning signal Yi transitions from the H level to the L level, the ON/OFF state of the TFT 1434 does not change, and therefore the lit/unlit state of the EL element is maintained.

Figure 3:
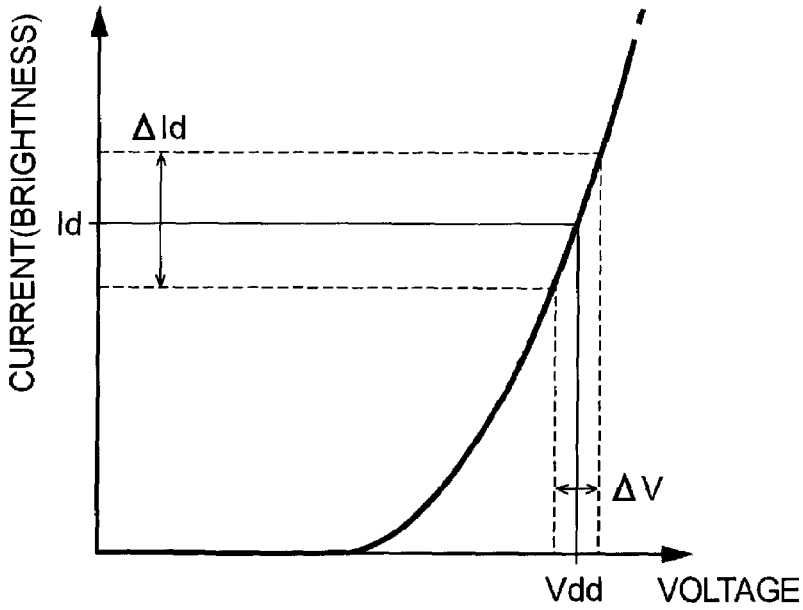
FIG. 3 is a graph that shows the voltage/brightness characteristic of the pixels.

In the embodiment, the EL element 1450 is either in the lit state or in the unlit state. However, the current-voltage characteristic of the EL element 1450 is the same as the characteristic of a diode. More specifically, as shown in FIG. 3, a current starts to flow without stopping when a voltage that is applied in the forward direction exceeds a threshold level. Therefore, a current-change width $\Delta Id$ increases with respect to a fluctuation width $\Delta V$ of the power supply voltage Vdd. The brightness of the EL element 1450 is substantially proportional to the amount of current. Therefore, when the power supply voltage Vdd varies even by only a very small amount, the amount of current changes significantly. Subsequently, the brightness of the EL element 1450 in the lit state also changes significantly.

Thus, in the case where the EL element 1450 is used, a significant or the most important problem is how to maintain the power supply voltage Vdd at a constant level.

<Y Driver>

Figure 4:
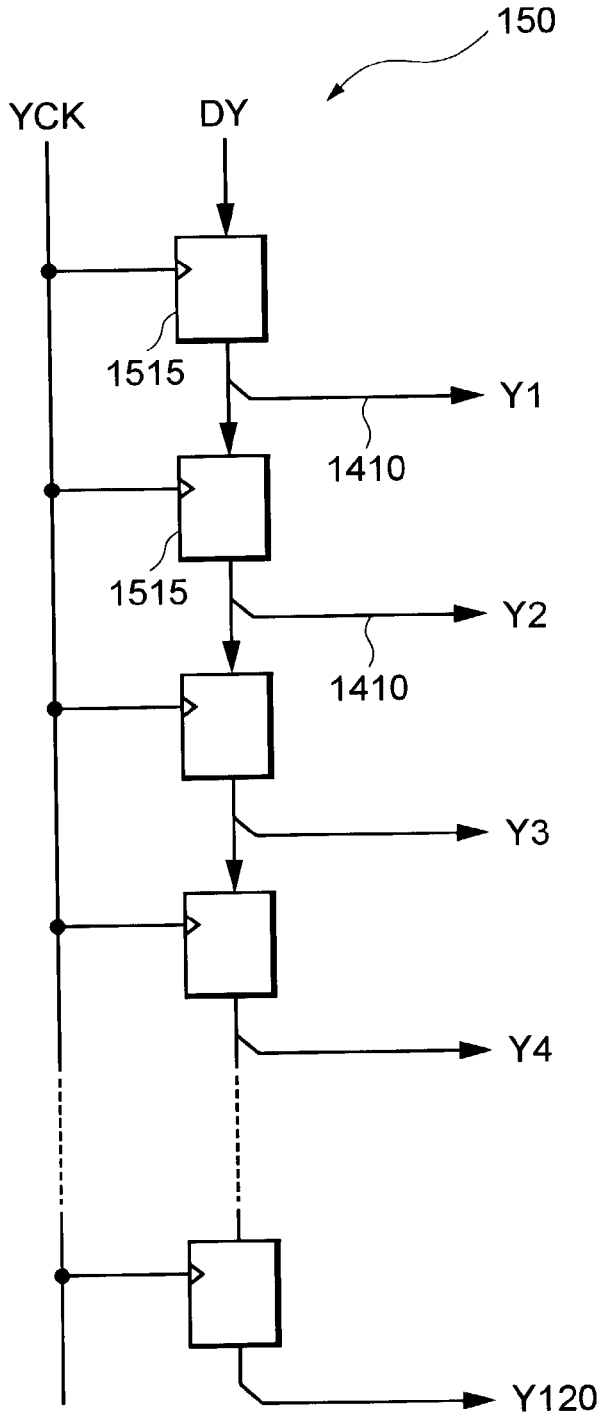
FIG. 4 is a schematic illustrating the configuration of a Y driver of the display unit.

Next, the details of the above-described Y driver 150 are described. FIG. 4 is a schematic illustrating the configuration of the Y driver 150.

As shown in FIG. 4, the Y driver 150 is a shift register. The Y driver 150 has a transfer circuit 1515 that is provided for each row of the scanning lines 1410.

The Y driver 150 is supplied with a clock signal YCK and a start pulse DY that are generated by the display controller 120.

The clock signal YCK has a frequency represented by the reciprocal of one horizontal-scanning period (1H). The start pulse DY stipulates the start time of one vertical scanning period (1F).

The transfer circuit 1515 of row i latches an input signal so that the input signal is at the level where it was immediately before the clock signal YCK rose. Then, the transfer circuit 1515 transmits the latched input signal as the scanning signal Yi to the scanning line 1410 of row i. Further, the transfer circuit 1515 of row i transmits the latched input signal as an input signal to the next stage, which is the transfer circuit 1515 of row i+1. However, the start pulse DY is transmitted as an input signal to the transfer circuit 1515 of the first row.

Figure 5:
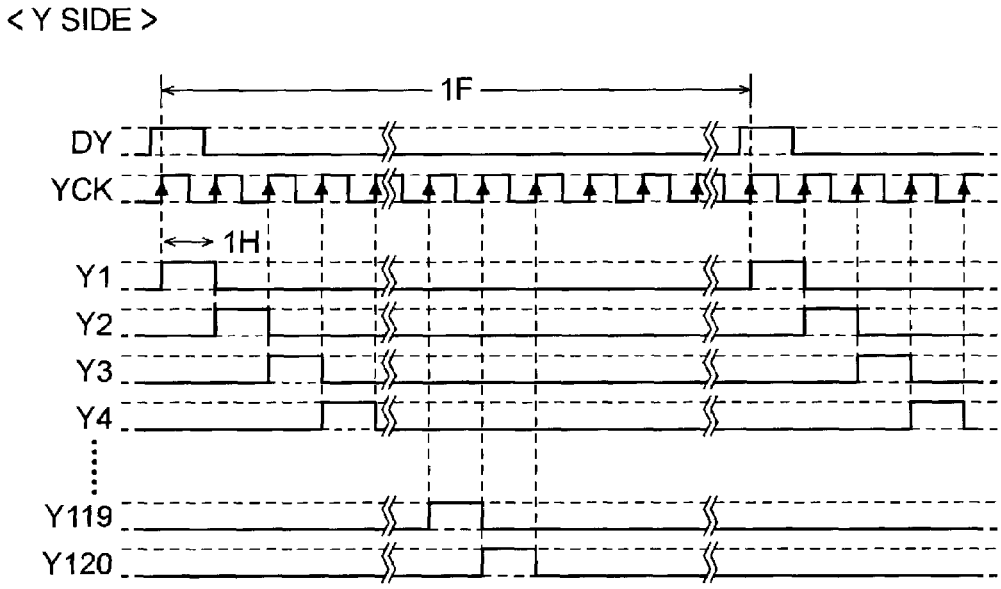
FIG. 5 is a timing chart illustrating the operation of the Y driver.

Then, the start pulse DY is supplied at the first part of one vertical-scanning period (IF), as shown in FIG. 5. The start pulse DY is sequentially shifted each time the clock signal YCK rises. Then, the shifted signal is output as the scanning signals Y1, Y2, Y3, Y4, . . . , and Y120 to the 1st, 2nd, 3rd, 4th, . . . , and 120th scanning lines 1410.

Subsequently, each of the scanning signals Y1, Y2, Y3, Y4, . . . , and Y120 sequentially reaches the H level and stays there for one horizontal scanning period (1H) after the start pulse DY reaches the H level and the clock signal YCK rises.

<X Driver>

Figure 6:
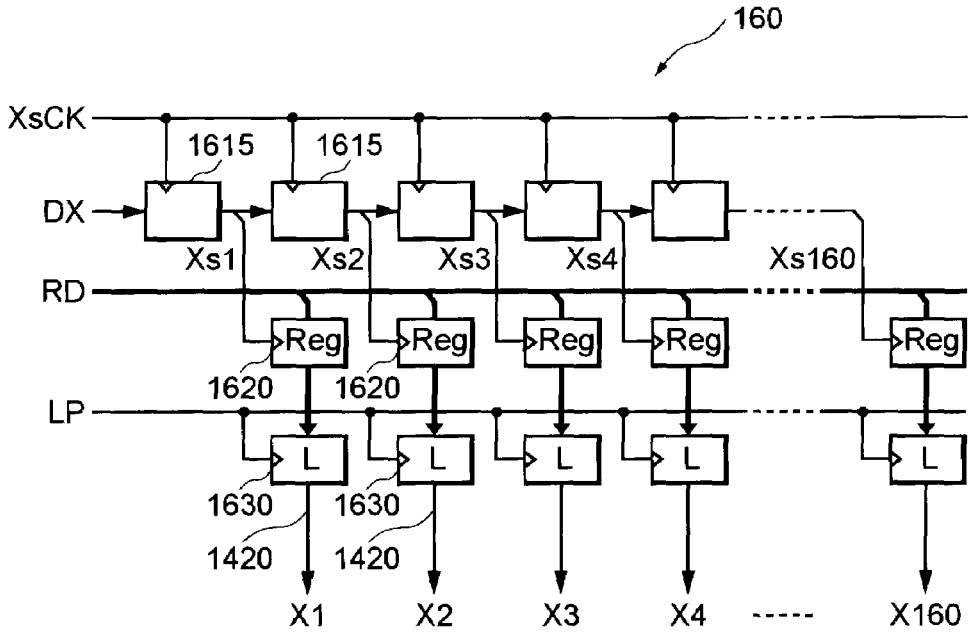
FIG. 6 is a schematic illustrating the configuration of an X driver of the display unit.

Next, details of the above-described X driver 160 are described. FIG. 6 is a schematic illustrating a configuration of the X driver 160.

As shown in FIG. 6, the X driver 160 has a transfer circuit 1615, a register (Reg) 1620, and a latch circuit (L) 1630 for each column of the data lines 1420.

The X driver 160 is supplied with a clock signal XsCK, a start pulse DX, and a latch pulse LP generated by the display controller 120, and ON/OFF data RD read from the display memory 110.

The clock signal XsCK is a signal to transfer an input signal to the transfer circuit 1615. The periodicity of the clock signal XsCK is as long as the increment interval of the read address Rad. The start pulse DX is output when reading of one row's worth of the ON/OFF data RD is started. The latch pulse LP is output just after the ON/OFF data RD of the last 160th column is read out. Then, the latch pulse LP stipulates the start time of one horizontal scanning period.

The transfer circuit 1615 of column j latches an input signal so that the input signal is at the level where it was before the clock signal XsCK rose. Then, the transfer circuit 1615 outputs the latched signal as a sampling control signal Xsj and transmits it as an input signal to the transfer circuit 1615 of column j+1, which is the next stage after the transfer circuit 1615 of column j. However, the start pulse DX is transmitted as an input signal to the transfer circuit 1615 of the first column.

Then, the register (Reg) 1620 of column j samples and holds the ON/OFF data RD, which is read from the display memory 110, when the sampling control signal Xsj rises after being output from the transfer circuit 1615 of column j.

Further, the latch circuit (L) 1630 of column j latches the ON/OFF data RD that is held by the register 1620 of column j when the latch pulse LP rises, and outputs the latched ON/OFF data RD as a data signal Xj to the data line 1420 of column j.

Figure 7:
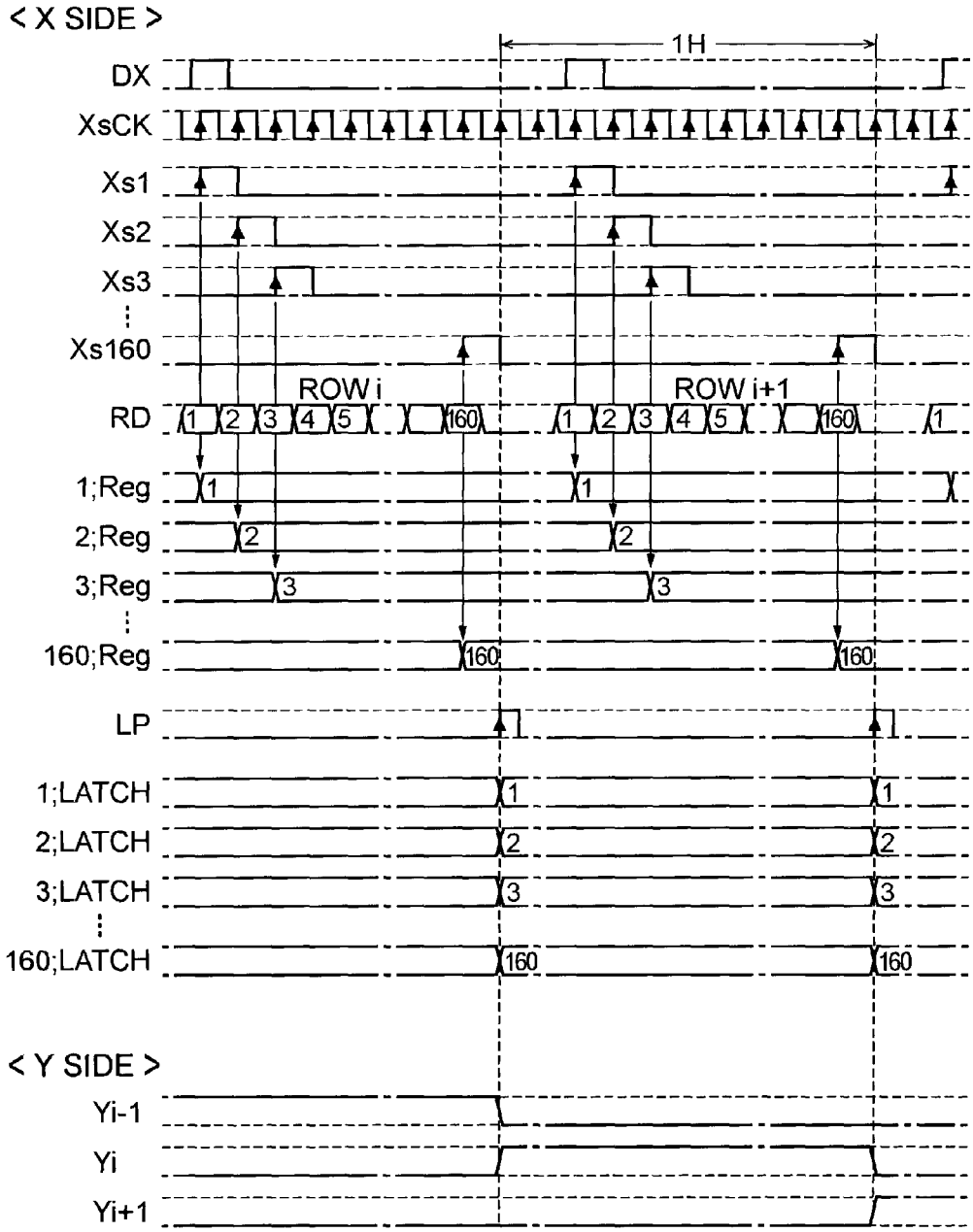
FIG. 7 is a timing chart illustrating the operation of the X driver.

FIG. 7 is a timing chart illustrating the operation of the X driver 160. As shown in FIG. 7, the start pulse DX rises and reaches the H level before the latch pulse LP is output, and the scanning signal Yi changes and reaches the H level. Subsequently, the ON/OFF data RD of row i, which corresponds to pixels of the 1st, 2nd, 3rd, . . . , and 160th columns, is sequentially read from the display memory 110 and transmitted.

When the ON/OFF data RD, which corresponds to the pixel of row i and the 1st column, is transmitted, a sampling control signal Xsl rises and reaches the H level. Then, the ON/OFF data is sampled by the register 1620 of the 1 st column (referred to as "1; Reg" in FIG. 7).

Next, when the ON/OFF data RD, which corresponds to the pixel of row i and the second column, is transmitted, a sampling control signal Xs2 rises and reaches the H level. Then, the ON/OFF data is sampled by the register 1620 of the 2nd column (referred to as "2; Reg" in FIG. 7). Similarly, each ON/OFF data RD, which corresponds to each of the pixels of the 3rd, 4th, . . . , and 160 columns, is sampled by each of the registers 1620 of the 3rd, 4th, . . . , and 160th columns.

Then, when the latch pulse LP is output, each of the ON/OFF data RD, which is sampled by each of the registers 1620, is latched by each of the latch circuits 1630 corresponding to each column simultaneously. Then, the ON/OFF data RD is output as data signals X1, X2, X3, . . . , and X16 simultaneously.

When one row's worth of data signals are output at a time, that is to say, in synchronization with the output of the latch pulse LP, the scanning signal Yi reaches and stays at the H level. Then, the scanning line 1410 of row i is selected.

Therefore, the pixels 1400 from the 1st to 160th column, which are on the scanning line 1410 of row i, are switched between the lit state and the unlit state according to the logic levels of the data signals X1, X2, X3, . . . , and X160. The states of the pixels 1400 are maintained even though the scanning signal Yi changes and stays at the L level until the scanning signal Yi changes and reaches the H level again by the next vertical scanning.

Thus, the above-described operations are performed to output the data signals corresponding to the pixels on row i. However, such output operations are sequentially performed so as to correspond to each of the 1st, 2nd, 3rd, . . . , and 120th scanning lines 1410. As a result, the states of the entire pixels are determined to display an image.

<Power Supply circuit>

Figure 8:
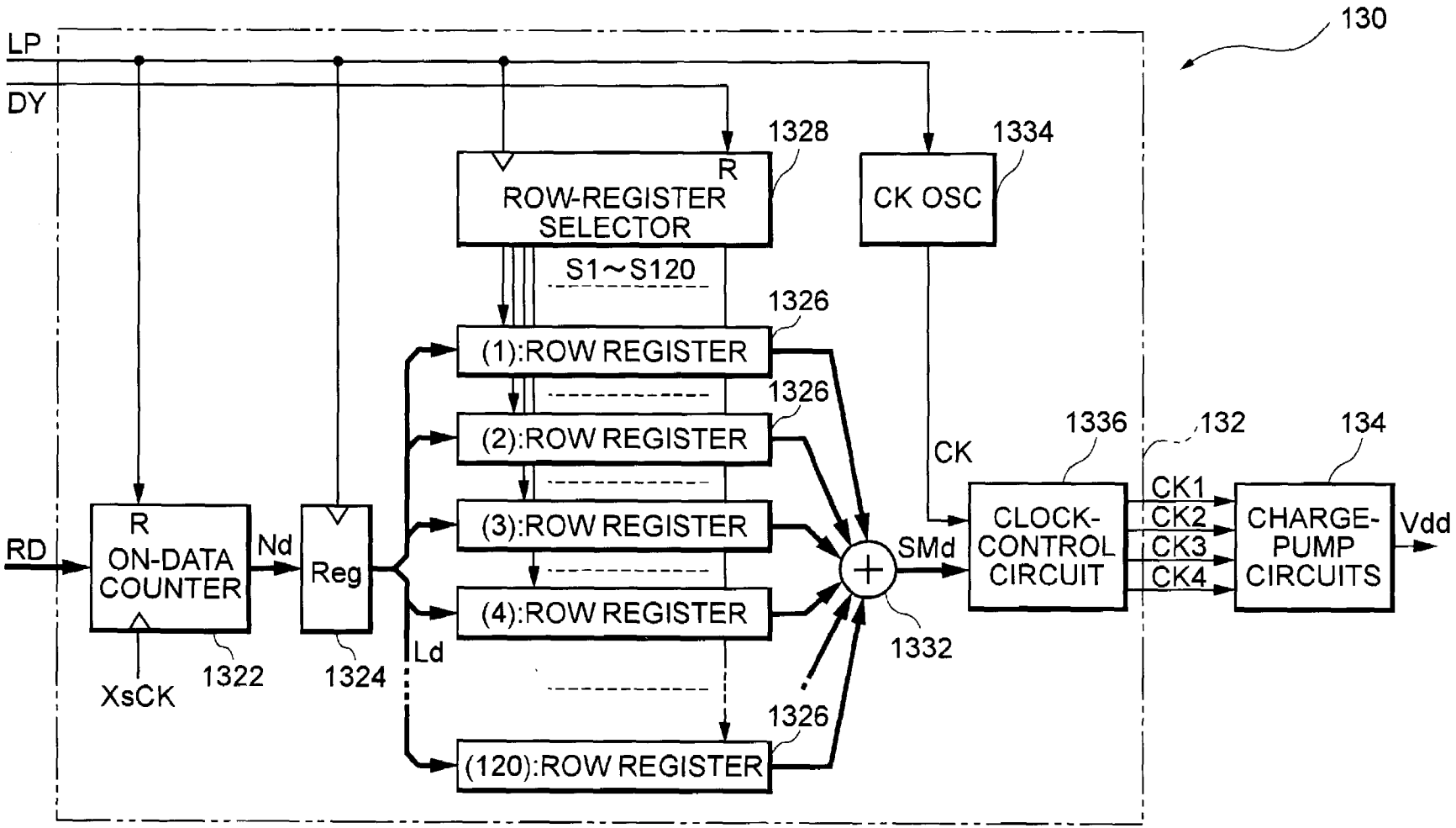
FIG. 8 is a schematic illustrating the configuration of a power supply circuit of the display unit.

Details of the power supply circuit 130 are described below. FIG. 8 is a schematic illustrating a configuration of the power supply circuit 130. As shown in FIG. 8, the power supply circuit 130 has a power controller 132 to calculate the total number of pixels stipulated to be lit by using the ON/OFF data RD, which is read from the display memory 110, and to generate clock signals CK1, CK2, CK3, and CK4 according to the calculation result. Further, the power supply circuit 130 has a plurality of charge-pump circuits 134 to generate a power supply voltage Vdd at an output impedance according to the clock signals and to supply the power supply voltage Vdd to the display panel 140. The power controller 132 includes an on-data counter 1322, a register (Reg) 1324, row registers 1326, a row-register selector 1328, an adder 1332, a clock-signal oscillator (CKOSC) 1334, and a clock-control circuit 1336.

The on-data counter 1322 outputs a count value Nd obtained by incrementing the ON/OFF data RD when the ON/OFF data RD is at the H level at the instant when the clock signal XcCK rises, and resets the count value Nd when the latch pulse LP rises.

Just before the latch pulse LP rises, the register 1324 latches the count value Nd and outputs it as a count value Ld.

One hundred and twenty row registers 1326 are provided. Each of the registers 1326 is provided for a corresponding row of the array of pixels. The row register 1326 corresponding to row i latches the count value Ld when a selection signal Si is at an active level.

The row-register selector 1328 outputs selection signals S1 to S120 to select one row register 1326 to make it re-latch the count value Ld, which is latched by the register 1324. More specifically, the row-register selector 1328 increments the rise of the latch pulse LP, selects one signal corresponding to the count value from the selection signals S1 to S120, and outputs the signal as an active level. Further, the row-register selector 1328 resets the count value when the above-described start pulse DY rises.

The adder 1332 adds all count values Ld together, which are latched by the 120 row registers 1326. Then, the adder 1332 outputs data SMd representing the addition result.

The clock-signal oscillator 1334 generates the clock signal CK in synchronization with the latch pulse LP. More specifically, the clock-signal oscillator 1334 has the same period as one horizontal scanning period (1H), which is the output period of the latch pulse LP, and generates the clock signal CK at a duty ratio of 50 percent. The clock signal CK changes to the H level when the latch pulse LP rises. That is to say, the clock signal CK is generated so as to be at the H level in the first half of each horizontal scanning period and at the L level in the latter half thereof.

The clock-control circuit 1336 divides the clock signals CK into four systems and asserts or de-asserts the output of each system according to the value indicated by data SMd. More specifically, the clock-control circuit 1336 determines to which of sixteen split domains (or values) shown in FIG. 9 the value indicated by data SMd corresponds. Then, according to the determined domain, the clock-control circuit 1336 asserts or de-asserts the output of each of the clock signals CK1, CK2, CK3, and CK4, which are divided into four systems.

For example, when the value indicated by the data SMd is "6522", the clock-control circuit 1336 asserts the outputs of the clock signals CK2 and CK3 and de-asserts the outputs of the clock signals CK1 and CK4.

The value indicated by the data SMd indicates the total number of pixels in the lit state in one horizontal scanning period where a row concerned is selected, as described below. Therefore, according to the embodiment, the maximum value of the data SMd is "19200" (=120×160), which is obtained when all of the pixels 1400 are in the lit state.

Figure 10:
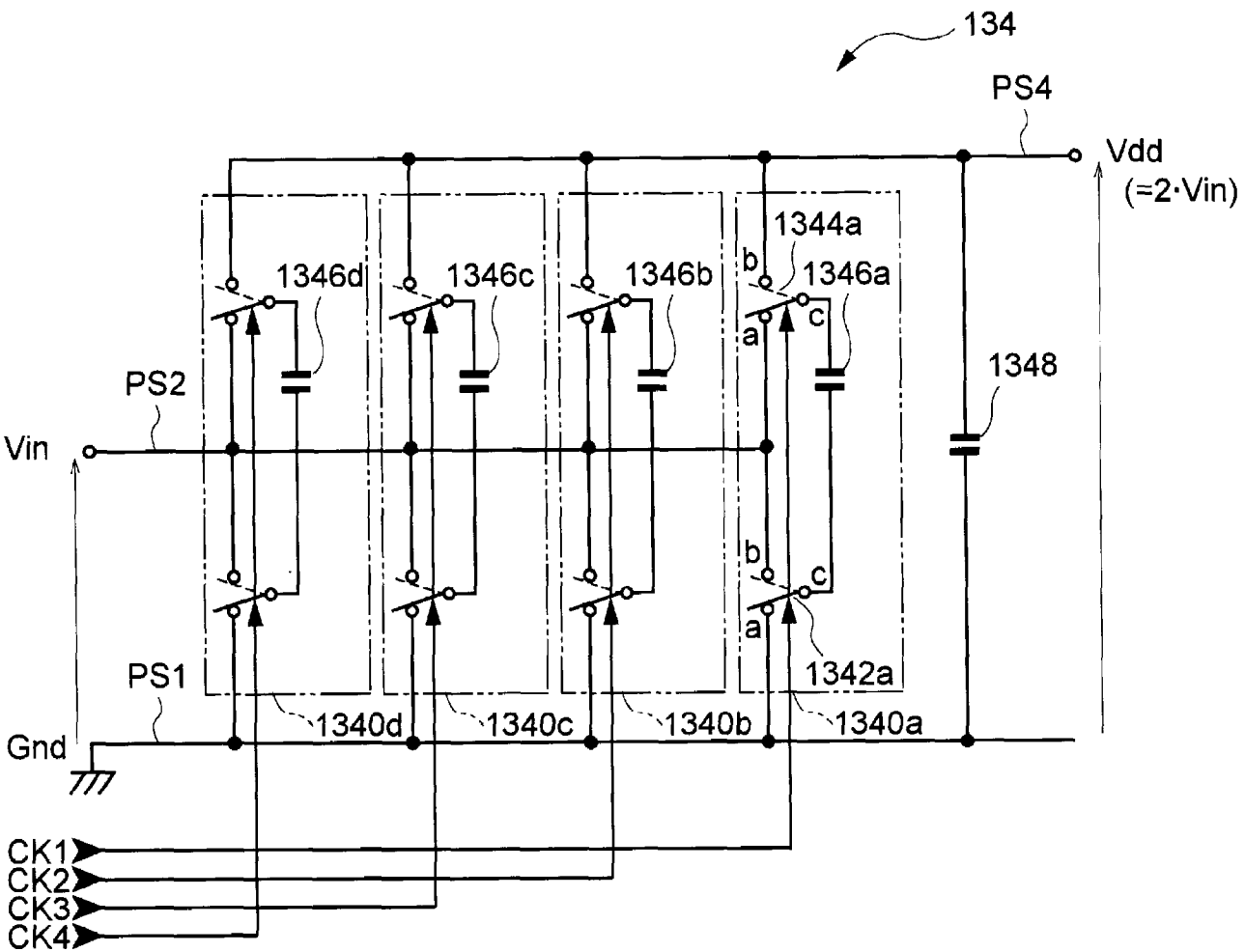
FIG. 10 is a circuit diagram illustrating the configuration of charge-pump circuits of the power supply circuit.

Next, details of the plurality of charge-pump circuits 134 are described. FIG. 10 is a circuit diagram illustrating a configuration of the plurality of charge-pump circuits 134.

As shown in FIG. 10, the charge-pump circuits 134 have charge-pump circuits 1340*a*, 1340*b*, 1340*c*, and 1340*d*, which are controlled by the clock signals CK1, CK2, CK3, and CK4, and a capacitor 1348, for protection, which is provided between feeding lines PS1 and PS4 for generating the voltage Vdd, which is commonly applied to the positive electrodes of the EL elements 1450, between the feeding lines PS1 and PS4 by a line voltage Vin between the feeding lines PS1 and PS2.

One of the charge-pump circuits 1340, namely, the charge-pump circuit 1340*a*, includes double-throw switches 1342*a* and 1344*a*, and a capacitor 1346*a* to store an electrical charge. One end of the capacitor 1346*a* is connected to a common terminal "c" of the switch 1342*a*. The other end of the capacitor 1346*a* is connected to a common terminal "c" of the switch 1344*a*.

When the clock signal CK1 is at the L level, each of the switches 1342*a* and 1344*a* is closed between a terminal "a" and the terminal "c", as shown by the solid lines in FIG. 10. On the other hand, when the clock signal CK1 is at the H level, each of the switches 1342*a* and 1344*a* is closed between the terminal "b" and the terminal "c", as shown by the broken lines in FIG. 10.

In order to charge and discharge the capacitor 1346*a*, the terminal "a" of the switch 1342*a* is connected to the feeding line PS1. The feeding line PS1 is maintained at a potential Gnd serving as a reference voltage. Further, the terminal "b" of the switch 1342*a* is connected to the feeding line PS2 to which the input voltage Vin is applied. The terminal "a" of the switch 1344*a* is connected to the feeding line PS2. Further, the terminal "b" of the switch 1344*a* is connected to the feeding line PS4, which is the output line of the voltage Vdd.

Further, when the clock signal CK1 is at the L level, each of the switches 1342*a* and 1344*a* is closed between the terminals "a" and "c". Therefore, the capacitor 1346*a* is charged with reference to the potential Gnd of the feeding line PS1. Subsequently, the capacitor 1346*a* maintains the voltage Vin.

Then, when the clock signal CK1 changes to be at the H level, each of the switches 1342*a* and 1344*a* is closed between the terminals "b" and "c". Therefore, the capacitor 1346*a* discharges with reference to the potential of the feeding line PS2.

Subsequently, the voltage of the feeding line PS4 becomes a voltage 2·Vin obtained by adding the voltage Vin maintained by the capacitor 1346*a* to the voltage Vin in the feeding line PS2. Then, the voltage 2·Vin is transmitted as the power supply voltage Vdd to the display panel 140.

That is to say, the voltage reference of the capacitor 1346*a* is shifted up from the potential of the feeding line PS1 to that of the feeding line PS2. Therefore, the electrical charges that are accumulated when the switches are closed between the terminals "a" and "C" and that correspond to the voltage Vin are stored to generate the power supply voltage Vdd.

The voltage 2·Vin (=Vdd) is protected by the capacitor 1348. Therefore, if the clock signal CK1 is at the L level again, the voltage of the feeding line PS4 is maintained at the voltage 2·Vin by the capacitor 1348.

The configuration of the charge-pump circuits 1340*b*, 1340*c*, and 1340*d* is the same or substantially the same as that of the charge-pump circuit 1340*a*. However, a difference between the charge-pump circuit 1340*a* and the charge-pump circuits 1340*b*, 1340*c*, and 1340*d*, is that closing of the switches of the charge-pump circuits 1340*b*, 1340*c*, and 1340*d* is controlled by the clock signals CK2, CK3, and CK4. Further, if the capacitance of the capacitor 1346*a* is "1", the ratio between the capacitance of the capacitor 1346*a* and that of the capacitor 1346*b* is 1:2. Further, the ratio between the capacitance of the capacitor 1346*a* and that of the capacitor 1346*c* is 1:4. Further, the ratio between the capacitance of the capacitor 1346*a* and that of the capacitor 1346*d* is 1:8.

According to the embodiment, each of the terminals "b" of the switches 1342*a*, 1342*b*, 1342*c*, and 1342*d* is connected to the feeding line PS2. However, the terminals "b" are each provided to change the reference potential during charging and discharging. Therefore, another feeding line PS3 with a potential different from that of the feeding line PS1 may be provided, and each of the terminals "b" may be connected to the feeding line PS3.

Figure 11:
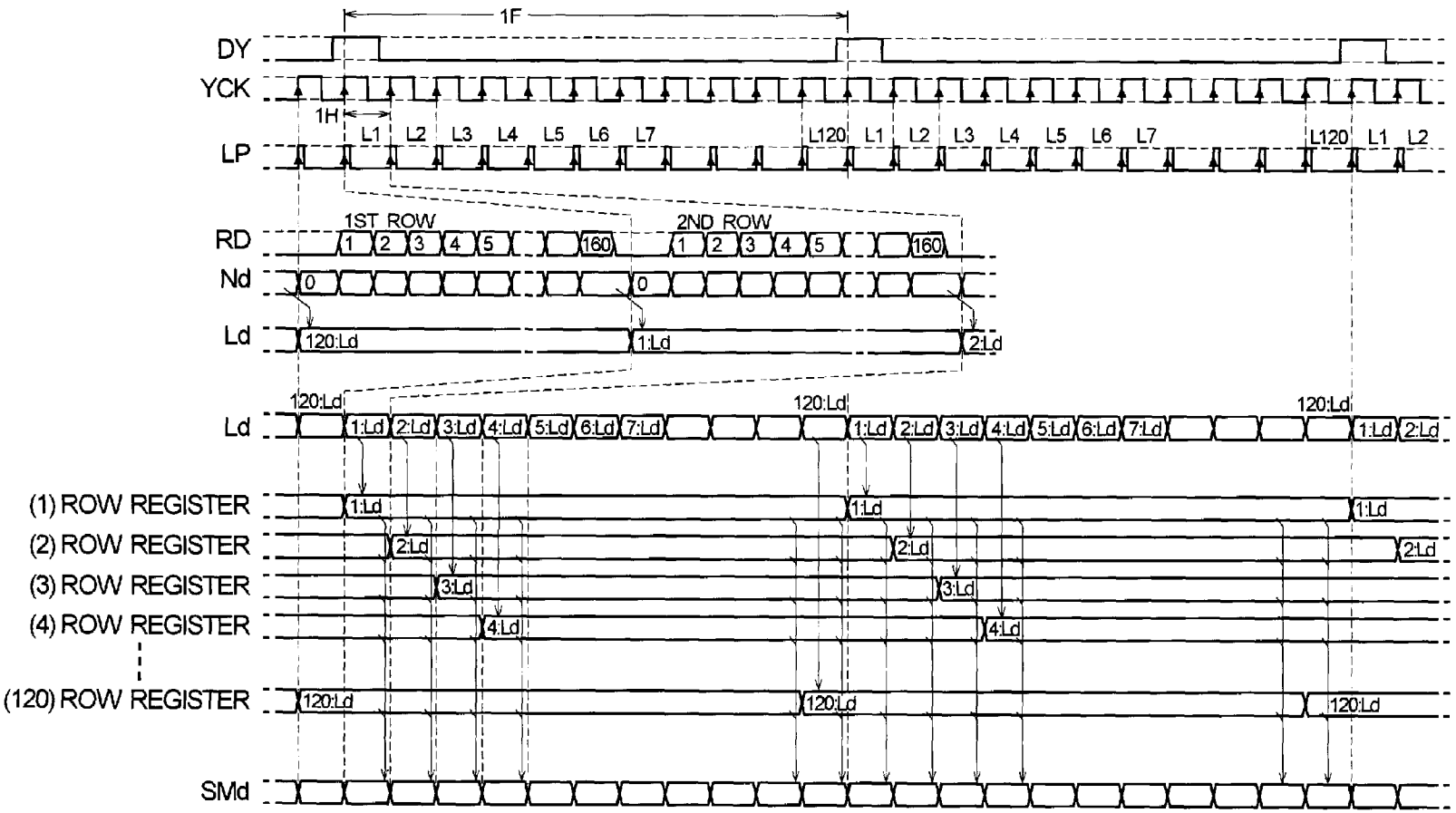
FIG. 11 is a timing chart illustrating the operation of the power supply circuit.

Next, the operation of the above-described power supply circuit 130 is described. FIG. 11 is a timing chart illustrating the operation of the power supply circuit 130.

As described above, one row's worth of the ON/OFF data RD from the first column to the 160th column is transmitted in synchronization with the clock signal XsCK after the latch pulse LP, which stipulates the start of a period to select a row just before the row in question, is output, and before the latch pulse LP, which stipulates the start of a period to select the row in question, is output.

Subsequently, the count value Nd of the on-data counter 1322 is reset to zero by the output of the latch pulse LP, which stipulates the start of the period to select the row just before the row in question. Then, the count value Nd is incremented every time the ON/OFF data RD, which stipulates the lit state of the row in question, is transmitted.

Therefore, the count value Nd immediately before the output of the latch pulse LP, which stipulates the start of the period to select the row in question, shows how many pixels of the 160 columns of pixels on the row in question are in the lit state. Therefore, the count value Ld, which is obtained by latching the count value Nd by the latch pulse LP, indicates the number of lit pixels of the pixels on the selected row (that is, the row in question) in one horizontal scanning period that is started by the latch pulse LP.

Reference to i:Ld in FIG. 11 indicates the count value Ld, which is latched corresponding to row i.

The row-register selector 1328 is reset by the start pulse DY, which stipulates the start of one vertical scanning period. When the rise of the latch pulse LP is incremented, the count value is incremented by "1" for every one horizontal scanning period. Therefore, the selection signals S1 to S120, which correspond to the count value, are sequentially at the active level for one horizontal scanning period (1H) after the start pulse DY is at the H level and the latch pulse LP rises. The period wherein the selection signals S1 to S120 are at the active level starts at the beginning of the period where the scanning signals Y1 to Y120 are at the H level and lasts for the period where the scanning signals Y1 to Y120 are at the H level, as shown in FIG. 5. Further, the period where the selection signals S1 to S120 are at the active level lasts for the period where the scanning signals Y1 to Y120 are at the H level, as shown in FIG. 5.

Therefore, when the latch pulse LP, which stipulates the start of the period to select row i, is output, only the selection signal Si, which corresponds to the row i, is at the active level. Subsequently, the counter value i:Ld, which indicates the number of pixels in the lit state of the pixels of the row i, is latched by the row register 1326, which corresponds to the row i.

Such latching is sequentially performed from the first row to the 120th row by the row registers 1326. Counter values 1:Ld to 120:Ld that are latched by the row registers 1326 show the number of lit pixels of the pixels of each row. Therefore, when the adder 1332 adds the counter values 1:Ld to 120:Ld together, the value of the data SMd, which shows the addition result, indicates the total number of lit pixels in one horizontal scanning period where the row in question is selected.

Figure 12:
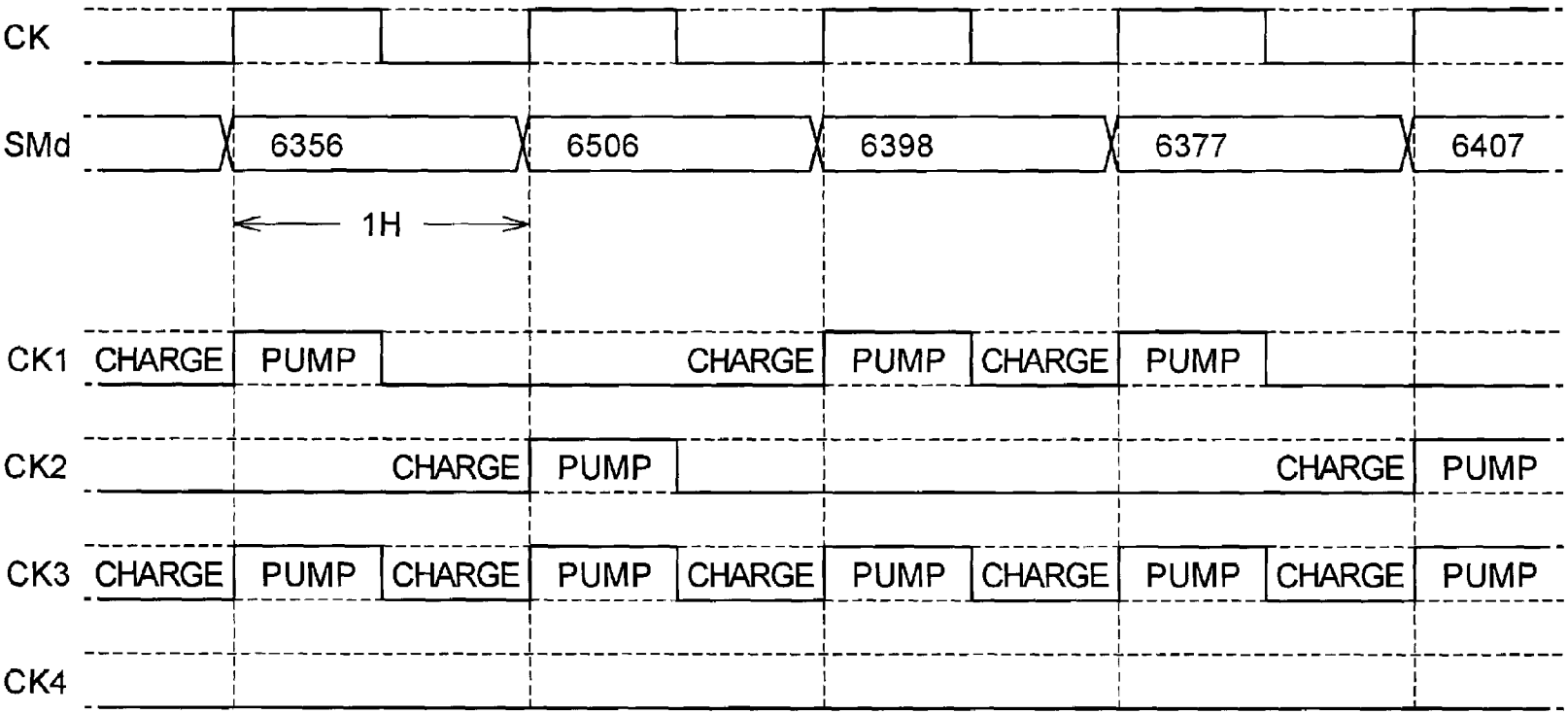
FIG. 12 is another timing chart illustrating the operation of the power supply circuit.

Here, when the value of the data SMd is "6356" in one horizontal scanning period (1H), as shown in FIG. 12, the number of lit pixels of the pixels 1400 in the one horizontal scanning period is 6356. In such a case, the clock-control circuit 1336 asserts the outputs of the clock signals CK1 and CK3 and de-asserts the outputs of the clock signals CK2 and CK4 as shown in the table of FIG. 9. Therefore, only the clock signals CK1 and CK3 are at the H level in the first half of the one horizontal scanning period.

As described above, the clock signals CK generated from the clock-signal oscillator 1334 are at the L level in the latter half of the horizontal scanning period. Therefore, irrespective of whether or not they are at the H level in the first half period of the one horizontal scanning period (1H), the clock signals CK1, CK2, CK3, and CK4 are at the L level in the latter half period of one horizontal scanning period before the one horizontal scanning period.

As described above, when only the clock signals CK1 and CK3 are at the L level, each of the capacitors 1346*a* and 1346*c* is charged and maintains the voltage Vin.

When the value of the data SMd is "6356" in the one horizontal scanning period, only the clock signals CK1 and CK3 are at the H level. Subsequently, the voltage Vin that is charged on the capacitors 1346*a* and 1346*c* is added to the voltage Vin that is applied to the feeding line PS2 and protected by the capacitor 1348. As described above, the capacitance ratio between the capacitors 1346*a* and 1346*c* is 1:4. Therefore, the amount of electrical charge that is stored for generating the voltage Vdd is relatively "5" in the one horizontal scanning period when the capacitance of the capacitor 1346*a* is "1".

That is to say, when the number of the lit pixels of the pixels 1400 in one horizontal scanning period (1H) is "6356", the amount of electrical charge that is stored to generate the voltage Vdd is indicated by a relative value "5".

Further, in the latter half period of the horizontal scanning period, the clock signals CK1, CK2, CK3 and CK4 are at the L level to store electrical charge in the next horizontal scanning period. Further, in each of the capacitors 1346*a*, 1346*b*, 1346*c*, and 1346*d*, the voltage Vin is maintained by charging.

In the next one horizontal scanning period (1H), when the total number of lit pixels is increased and the value of the data SMd is "6506", the clock-control circuit 1336 de-asserts the outputs of the clock signals CK1 and CK4. Therefore, in the first half of the one horizontal scanning period, only the clock signals CK2 and CK3 are at the H level. Subsequently, the voltages Vin that are charged by the capacitors 1346*b* and 1346*c* are added to the voltage Vin applied to the feeding line PS2 and protected by the capacitor 1348.

As described above, the capacitance ratio between the capacitors 1346*b* and 1346*c* is 2:4. Therefore, the amount of electrical charge that is stored for generating the voltage Vdd in the one horizontal scanning period is relatively "6".

That is to say, in one horizontal scanning period (1H) when the total number of lit pixels is "6506", which is larger than that in the previous horizontal scanning period when the total number of the lit pixels if "6356", the load on the power supply voltage Vdd in the display panel 140 is increased according to the increase in the number of lit pixels. However, the amount of electrical charge that is stored to generate the voltage Vdd is increased relatively from "5" to "6". Thus, according to the embodiment, even though the load on the power supply voltage Vdd is increased, the drop in the voltage Vdd is reduced.

On the other hand, in the next one horizontal scanning period (1H), when the total number of lit pixels is decreased and the value of the data SMd is "6398", the clock-control circuit 1336 de-asserts the outputs of the clock signals CK2 and CK4. Therefore, in the first half of the one horizontal scanning period, only the clock signals CK1 and CK3 are at the H level. Therefore, the amount of electrical charge that is stored to generate the voltage Vdd in the one horizontal scanning period is relatively "5".

That is to say, in one horizontal scanning period (1H) when the total number of the lit pixels is "6398", which is smaller than that in the previous horizontal scanning period when the total number of lit pixels is "6506", the load on the power supply voltage Vdd in the display panel 140 is decreased according to the decrease in the number of lit pixels. The amount of electrical charge that is stored to generate the voltage Vdd is decreased relatively from "6" to "5". Accordingly, the power consumption is reduced.

However, if the value of the data SMd is slightly decreased, for example, from "6398" to "6377" in the next horizontal scanning period (1H), such a change in the total number of lit pixels can be ignored. Therefore, the clock-control circuit 1336 asserts the outputs of the clock signals CK1 and CK3, as in the case of the previous horizontal scanning period. Subsequently, the amount of electrical charge that is stored to generate the voltage Vdd is maintained relatively at "5", which is the same as that of the previous horizontal scanning period.

<Comparison of the Present Invention and the Related Technology>

Figure 16:
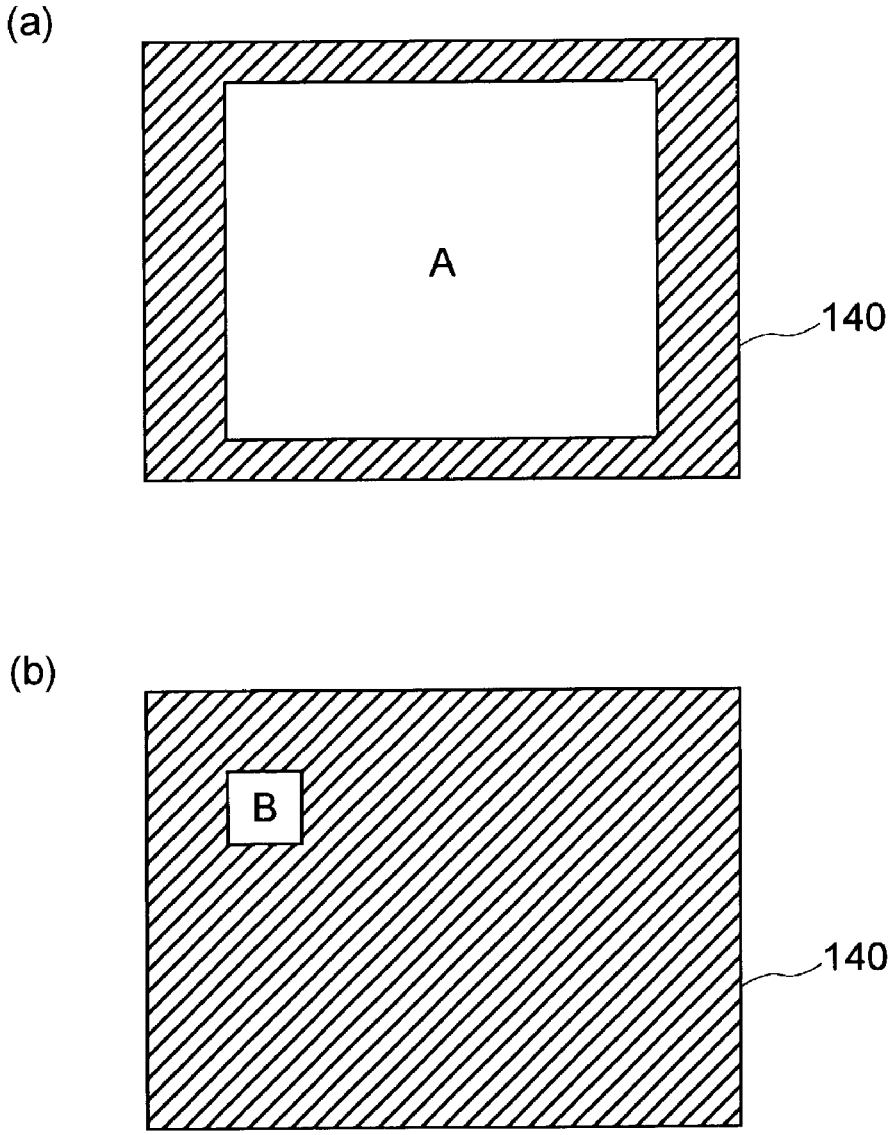
FIGS. 16(*a*) and 16(*b*) are schematics that illustrate displays of the same gradation and the difference between the brightness of the displays, the difference occurring due to the difference between the areas of the displays of the same gradation.

As a comparison of the embodiment and the related technology, it may be simply arranged that a predetermined amount of electrical charge is stored with a predetermined period without considering the total number of pixels in the lit state. In such a configuration, if there are many pixels in the lit state, as shown in FIG. 16(*a*) (when area A formed by pixels in the lit state is large), the load on the voltage Vdd is heavier than in a case where there are few pixels in the lit state, as shown in FIG. 16(*b*) (when area B formed by pixels in the lit state is small). Therefore, the discharge of the capacitor 1348 for protection proceeds and the drop of the voltage Vdd is increased accordingly. Subsequently, the brightness of the area A becomes lower than that of the area B, which should be represented by the same pixels in the lit state as that of the area A. In such a case, there would be a difference between the display of the area A and the display of the area B.

However, according to the embodiment, the total number of pixels in the lit state is calculated for every horizontal scanning period. According to the calculation result, the amount of electrical charge that should be stored to generate the power supply voltage Vdd of the display panel 140 is appropriately controlled. Therefore, the voltage fluctuation (a voltage drop) is reduced. As a result, the brightness of pixels in the lit state is kept substantially constant irrespective of the total number (the area) of the pixels. Therefore, the difference between displays can be reduced.

Further, according to the embodiments, when the total number of pixels in the lit state is small, unnecessary electric charge is not stored. Therefore, the power consumption becomes lower than in the above-described case, which is presented for comparison.

<Application and Modification>

The present invention is not limited to the above-described embodiments, and instead can be applied and modified in various ways. For example, according to the embodiments, the pixels are in the lit state or in the unlit state for producing a binary display. However, a gradation display can also be produced according to the following configuration.

Figure 13:
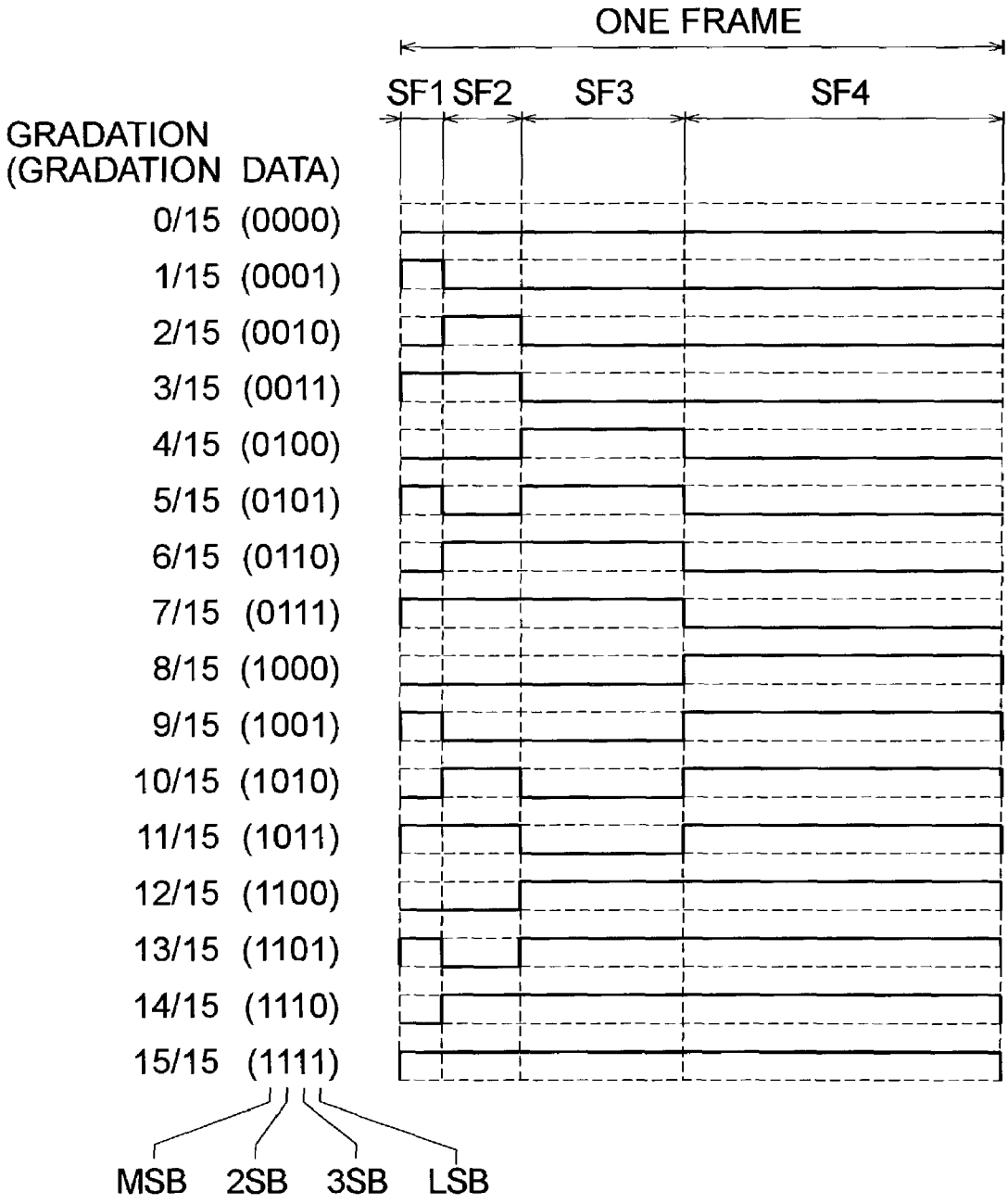
FIG. 13 is a chart that illustrates a gradation display produced by the display unit.

For example, in a case where a 16-step gradation from 0/15 to 15/15 is designated by 4 bits of gradation data, as shown in FIG. 13, one frame (or one field) is divided into subframes (or sub fields) SF4, SF3, SF2, and SF1 so that they correspond to the most significant bit (MSB), the second bit (2SB), the third bit (3SB), and the least significant bit (LSB) of the gradation data. Then, the proportion of the periods of the subframes SF4, SF3, SF2, and SF1 is set to 8:4:2:1 so that the subframes correspond to the weights of the bits MSB, 2SB, 3SB, and LSB. Further, in each subframe, pixels are unlit or lit according to whether the corresponding bit is "0" or "1". Subsequently, the proportion of the periods where the pixels are lit is controlled in 16 levels per frame. Therefore, a 16-step gradation from 0/15 to 15/15 can be presented.

According to this modification, however, the pixels in the subframes are lit or unlit according to the corresponding bits, as in the above-described embodiments. Therefore, vertical scanning periods are used as the subframes SF4, SF3, SF2, and SF1, and the display memory 110 stores the gradation data corresponding to the pixels. Further, for some subframes, a bit corresponding to the subframe is read from the 4 bits of gradation data. Then, the pixels are lit or unlit according to the read bit. In such a manner, a 16-step gradation display can be produced by the same configuration as that of the above-described embodiments. That is to say, even though such a gradation display is produced, the amount of electrical charge that is stored to generate the power supply voltage Vdd for the display panel 140 is controlled according to the total number of pixels in the lit state. Therefore, as in the case of the above-described embodiments, the fluctuations and drop of the voltage are reduced and the power consumption is reduced.

According to the above-described embodiments, the lit state or the unlit state of the pixels is maintained until the next vertical scanning is performed. That is to say, a holding-type display is produced. Therefore, particularly, in cases where moving images are displayed, pixels around the outlines of the moving images often appear as they did when the previous vertical scanning was performed, even though the next vertical scanning is performed. The occurrence of such a problem is facilitated by persistence of vision. In order to reduce the persistence of vision, a period where all pixels are forced to be unlit may be provided in each vertical scanning period (or in each subframe).

Here, in the periods where all pixels are forced to be unlit, the outputs of all the clock signals CK1, CK2, CK3, and CK4 are de-asserted. Subsequently, the amount of electrical charge that is stored to generate the power supply voltage Vdd becomes zero, and thus wasteful power consumption is reduced.

In the above-described embodiments, the capacitance ratio of the capacitors 1346*a*, 1346*b*, 1346*c*, and 1346*d* is set to 1:2:4:8, and electrical charge storage is performed once in every horizontal scanning period. The capacitors to perform the electrical charge storage one time are used in appropriate combination according to the total number of pixels that are in the lit state to control the amount of electrical charge that is stored. However, the present invention is not limited to the above-described configuration. For example, when storing electrical charge two or more times in one horizontal scanning period, the capacitance of a capacitor to store electrical charge can be reduced. Alternately, only one charge-pump circuit may be provided and the number of times electrical charge is stored per unit time (for example, in every one horizontal scanning period) may be determined in stages from one to sixteen according to the total number of pixels in the lit state.

However, it is undesirable to unnecessarily increase the number of times electrical charge is stored per unit time for the following reason. That is to say, the larger the number of times electrical charge is stored per unit time, the higher the frequency of the clock signals CK becomes. If the frequency of the clock signals CK becomes higher, the power consumption due to switching performed by the clock signals CK and the power consumed by parasitic capacitances in the signal lines of the clock signals CK will become too high to be ignored. In such a case, the power consumption cannot be reduced.

According to the above-described embodiments, the power supply voltage Vdd is transmitted to the display panel 140 by the plurality of charge-pump circuits 134. However, the power supply voltage Vdd may be transmitted to the display panel 140 through various kinds of configurations.

Figure 14:
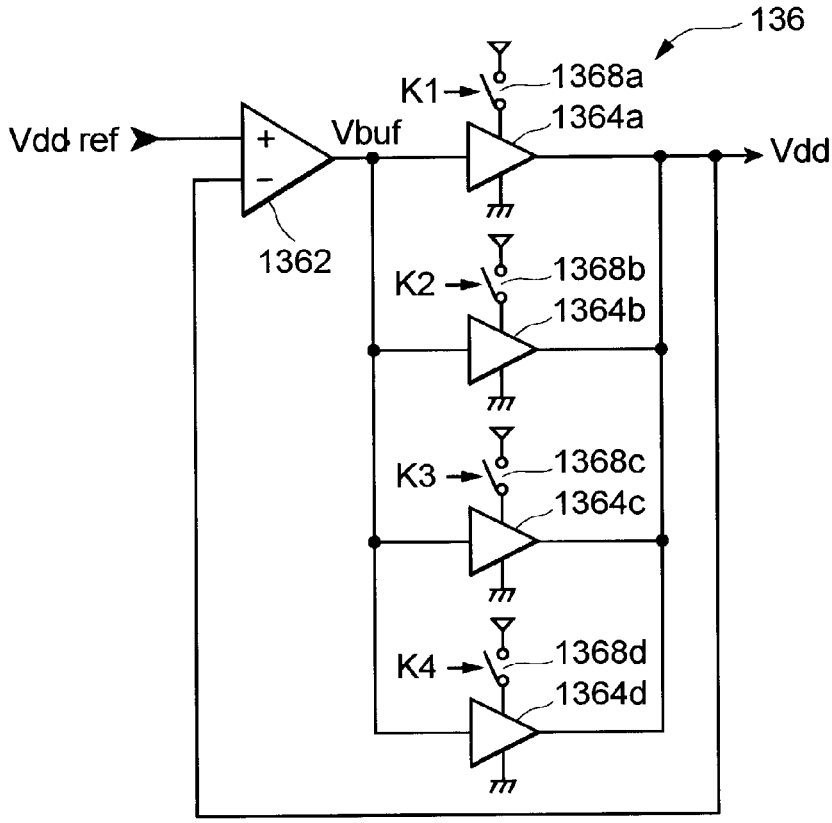
FIG. 14 is a schematic illustrating a configuration of a circuit that can be used as a substitute for charge-pump circuits of the power supply circuit.

For example, as shown in FIG. 14, a plurality of buffers may be used to transmit the voltage Vdd. In FIG. 14, buffers 1364*a*, 1364*b*, 1364*c*, and 1364*d* that are connected in parallel amplify an output voltage Vbuf from an operational amplifier 1362 by a gain "1" in a noninverting manner. Then, the buffers 1364*a*, 1364*b*, 1364*c*, and 1364*d* output the voltage Vdd.

However, the impedance of these buffers is not zero, which is ideal, and instead is reduced in stages, that is, 8:4:2:1. Further, switches 1368*a*, 1368*b*, 1368*c*, and 1368*d* are provided on power-supply lines of the buffers 1364*a*, 1364*b*, 1364*c*, and 1364*d*. The switches are turned on only when control signals K1, K2, K3, and K4 are at the H level. The control signals K1, K2, K3, and K4 are signals corresponding to the clock signals CK1, CK2, CK3, and CK4 in the above-described embodiments. The control signals K1, K2, K3, and K4 are at the H level only when the outputs of corresponding clock signals are asserted.

Figure 15:
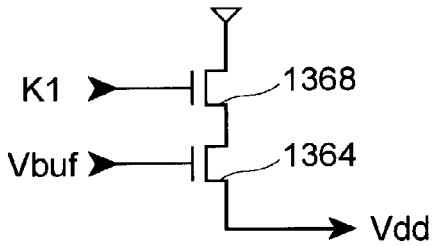
FIG. 15 is a schematic that illustrates a configuration of a typical buffer in the circuit shown in FIG. 14.

Here, the most simple configuration of the buffer 1364*a* and the switch 1368*a* is described. For example, as shown in FIG. 15, a circuit including a TFT 1368 to input the control signal K1 to a gate and a TFT 1364 to input the voltage Vbuf to a gate may be provided. The TFTs 1368 and 1364 are connected in series between a power-supply line for operational amplifiers or the like and an output line for the voltage Vdd. The size of the TFTs is gradually increased so that the impedance thereof is reduced in stages. The size of the buffers and switches is also increased as in the case of the TFTs.

A reference voltage Vdd·ref is input to the positive input-terminal of the operational amplifier 1362 and the voltage Vdd is input to the negative input-terminal thereof. Therefore, the operational amplifier 1362 outputs the voltage Vbuf so that the voltage Vbuf matches with the reference voltage Vdd·ref. Here, the condition Vbuf=Vdd holds. Therefore, in a case where the circuit in FIG. 15 is used, the voltage Vdd transmitted to the display panel 140 is subjected to negative feedback control so that the voltage Vdd matches with the reference voltage Vdd·ref According to the above-described configuration, according to the total number of pixels which are to be in the lit state, the combination of the buffers 1364*a*, 1364*b*, 1364*c*, and 1364*d* that are operating is changed, and the output impedance of the voltage Vdd is controlled appropriately. More specifically, the output impedance of the voltage Vdd is controlled to be lower as the total number of pixels in the lit state increases. Thus, according to the configuration, the voltage fluctuation is reduced as in the cases of the above-described embodiments. Further, since no power is supplied to buffers that are not operating, such buffers are prevented from being idle. Accordingly, the power consumption can be reduced.

As described above, the display unit uses the EL elements as electrooptical elements. However, the present invention is not limited to the above-described cases. That is to say, the display apparatus can use LEDs, liquid-crystal elements, electrophoretic elements, digital micro mirror devices (DMD), and various kinds of electrooptical elements using plasma light emission, fluorescence by electron emission, and so forth as pixels in addition to the EL elements 1450, for example. Further, the present invention can be used for an electronic apparatus including a display unit using the above-described elements. However, in a case where the liquid-crystal elements, which are generally driven by an alternating current, are used as the pixels, it is necessary to transmit voltages that are to be applied to the electrodes of the pixels alternately at evenly spaced periods with reference to the potential of a common electrode. That is to say, a display panel using liquid-crystal elements as pixels requires two kinds of power supply voltages for the positive electrode and the negative electrode. In such a case, calculation is performed to determine whether the pixels are turned on with a positive polarity or with a negative polarity. Then, according to the total number of pixels that are turned on with a positive polarity, a power supply voltage of a positive polarity may be generated. On the other hand, a power supply voltage of a negative polarity may be generated according to the total number of pixels that are turned on with a negative polarity.

There are two different cases where the liquid-crystal elements are used. That is to say, in one case, the liquid-crystal elements are displayed in white (a normally white mode) when they are turned off (when no voltage is applied). In another case, the liquid crystal elements are displayed in black (a normally black mode) when they are turned off. Therefore, it should be noted that the liquid-crystal elements are not always in the lit state (a bright state) when they are turned on, which is different from the case where the EL elements 1450 are used.

[Advantages]

Thus, according to the present invention, the total number of pixels that are turned on is calculated, and the output impedance of the voltage generation circuit is controlled so that the output impedance becomes lower as the calculated total number increases. Subsequently, the fluctuation (the drop) in the power supply voltage is reduced. As a result, it becomes possible to prevent or substantially prevent the brightness of pixels in the ON state from changing according to whether the area of a display produced by pixels in the ON state is large or small.

What is claimed is:

1. A power supply circuit for a display unit that transmits a power supply voltage to a display panel having pixels that are turned on when the power supply voltage is energized and that are turned off when the power supply voltage is non-energized, the power supply circuit comprising:

a calculation circuit to calculate a total number of pixels that are turned on in the display panel;

a voltage generation circuit to make the output impedance of a power supply voltage variable and to transmit the power supply voltage to the display panel;

a control circuit to control the output impedance of the voltage generation circuit so that the output impedance becomes lower as the total number of pixels calculated by the calculation circuit increases;

a clock-signal oscillator to generate a clock signal to control the voltage generation circuit; and a clock-control circuit to (a) divide generated clock signals into a plurality of systems, (b) determine to which of a plurality of split domains values of the clock signals correspond in accordance with a calculation in the calculation circuit, and (c) at least one of assert or de-assert the output of each of the clock signals that are divided into the plurality of systems, wherein the output impedance of the power supply voltage is controlled in accordance with the output of each of the clock signals.

2. The power supply circuit for a display unit according to claim 1, the voltage generation circuit including a plurality of charge-pump circuits that are connected in parallel, the plurality of charge-pump circuits each including:

a charging and discharging element that is chargeable and dischargeable; and a switch to make the charging and discharging element charge and discharge alternately with reference to potentials that are different from each other, a voltage discharged by the charging and discharging element being used as the power supply voltage, and the control circuit controlling switching of the plurality of charge-pump circuits.

3. The power supply circuit for a display unit according to claim 2, the charging and discharging element being a capacitor to accumulate electrical charge, and the amount of electrical charge that can be accumulated being represented by a value shown as a power of 2 for each of the plurality of charge-pump circuits.

4. The power supply circuit for a display unit according to claim 1, the voltage generation circuit including a plurality of buffers that are connected in parallel to buffer and output an input voltage, and the control circuit controlling an output to each of the buffers.

5. The power supply circuit for a display unit according to claim 1, the calculation circuit including:

a row register that is provided for each row of the arrayed pixels to store the number of pixels that are turned on on the row thereof when horizontal scanning is performed for the row; and an addition circuit to calculate the total of the number of pixels stored by each of the row registers.

6. A method for controlling a power supply circuit for a display unit to control transmission of a power supply voltage to a display panel having pixels which have a brightness that is stipulated according to an energization state of the power supply voltage, the method comprising:

calculating a load on the display panel from data that stipulates the brightness of the pixels;

controlling an output impedance of a voltage generation circuit to transmit the power supply voltage to the display panel so that the output impedance is reduced as the calculated load increases;

generating a clock signal to control the voltage generation circuit;

dividing generated clock signals into a plurality of systems;

detennining to which of a plurality of split domains values of the clock signals correspond in accordance with the calculated load; and at least one of asserting or de-asserting the output of each of the clock signals that are divided into the plurality of systems, wherein the output impedance of the power supply voltage is controlled in accordance with the output of each of the clock signals.

7. A display unit, comprising:

a display panel having pixels that are aligned, and that are turned on when a power supply voltage is energized and that are turned off when the power supply voltage is non-energized;

a calculation circuit to calculate the total number of the pixels that are turned on in the display panel;

a voltage generation circuit to make the output impedance of the power supply voltage variable and to transmit the power supply voltage to the display panel; and a control circuit to control the output impedance of the voltage generation circuit so that the output impedance becomes lower as the total number of the pixels calculated by the calculation circuit increases;

a clock-signal oscillator to generate a clock signal to control the voltage generation circuit; and a clock-control circuit to (a) divide generated clock signals into a plurality of systems, (b) determine to which of a plurality of split domains values of the clock signals correspond in accordance with a calculation in the calculation circuit, and (c) at least one of assert or de-assert the output of each of the clock signals that are divided into the plurality of systems, wherein the output impedance of the power supply voltage is controlled in accordance with the output of each of the clock signals.

8. An electronic apparatus, comprising:

the display unit according to claim 7.

* * * * *